US005085047A

United States Patent [19]

Hofmann

[11] Patent Number: 5,085,047

[45] Date of Patent: Feb. 4, 1992

[54] OPENING ROLL FOR AN OPEN-END SPINNING DEVICE

[75] Inventor: Eberhard Hofmann, Ingolstadt, Fed. Rep. of Germany

[73] Assignee: Schubert & Salzer Maschinenfabrik Aktiengesellschaft, Ingolstadt, Fed. Rep. of Germany

[21] Appl. No.: 671,165

[22] Filed: Mar. 14, 1991

Related U.S. Application Data

[63] Continuation of Ser. No. 392,216, Aug. 10, 1989, abandoned.

[30] Foreign Application Priority Data

Aug. 8, 1989 [DE] Fed. Rep. of Germany ..... 8909448

[51] Int. Cl.[5] ..... D01H 4/10; D01G 15/14; D01G 19/10

[52] U.S. Cl. ..... 57/408; 19/97; 19/112

[58] Field of Search ..... 57/408, 409, 410, 411; 19/97, 98, 112, 114, 105; 242/68.5, 71.8

[56] References Cited

U.S. PATENT DOCUMENTS

| | | | |
|---|---|---|---|
| 3,973,740 | 8/1976 | Schankler | 242/68.5 |
| 4,044,427 | 8/1977 | Ankrom et al. | 19/97 |
| 4,122,656 | 10/1978 | Shaw | 57/408 |
| 4,300,265 | 11/1981 | Heinen | 19/112 |
| 4,342,137 | 8/1982 | Ennis et al. | 19/97 |
| 4,435,953 | 3/1984 | Schmid et al. | 57/408 |
| 4,461,141 | 7/1984 | Hofmann et al. | 57/408 |
| 4,530,133 | 7/1985 | Stewart et al. | 19/97 |
| 4,869,060 | 9/1989 | Stewart et al. | 57/408 X |

FOREIGN PATENT DOCUMENTS

| | | |
|---|---|---|
| 3515153 | 11/1985 | Fed. Rep. of Germany . |
| 29130 | 4/1973 | Japan . |
| 482913 | 4/1973 | Japan . |

*Primary Examiner*—Stanley N. Gilreath
*Attorney, Agent, or Firm*—Dority & Manning

[57] ABSTRACT

An opening roll for an open-end spinning device upon which clothing is carried. The opening roll includes a unitary member that has enlarged surfaces provided on circumferentially spaced ribs extending between a centrally located hub and a ring shaped concentric surface upon which pressure can be applied for ejecting the unitary member from a mold and for permitting drilling and filling with material for balancing.

1 Claim, 2 Drawing Sheets

OPENING ROLL FOR AN OPEN-END SPINNING DEVICE

This is a continuation of application Ser. No. 07/392,326, filed Aug. 10, 1989, which was abandoned upon the filing hereof.

The instant invention relates to an opening roll for an open-end spinning device, with a basic body attached to a shaft and with a clothing of teeth of pins and with a cavity extending into the basic body, as well as to a process for the production of an opening roll consisting at least partly of a hollow basic body with a clothing of teeth or pins.

An opening roll consisting of a basic body, an element receiving a clothing and a cover is known for example, from JP-Gm-OS 48/29130. The cover is attached on the basic body and clamps the clothing-receiving element between two flanks. The basic body is essentially made of a full material, ensuring that the surface receiving the clothing can be given a precisely round configuration in production. This is important in order to achieve good results in combing out a fiber tuft. The great quantity of material used is a disadvantage in this design. Furthermore, due to the great accelerated mass of the opening roll during balancing, much material must be removed from the appropriate locations in extreme cases in order to ensure balanced running of the opening roll. These disadvantages result in high production costs.

DE-OS 35 15 153 discloses an opening roll which is also composed of several parts. The body of the roll overlaps with an axial extension the end of a bearing housing which faces it, whereby a cavity is formed. The cavity is sealed against the outside by means of a ring insertion and a ring land constituting a sealing gap. Dirt penetrating into the cavity creates the danger of imbalance during operation. The ring land is integrally molded to the roll body and constitutes an undercut of the cavity. This is expensive in manufacture.

It is the object of the instant invention to create a low-cost opening roll ensuring very true running and weighing little.

Figure 1:
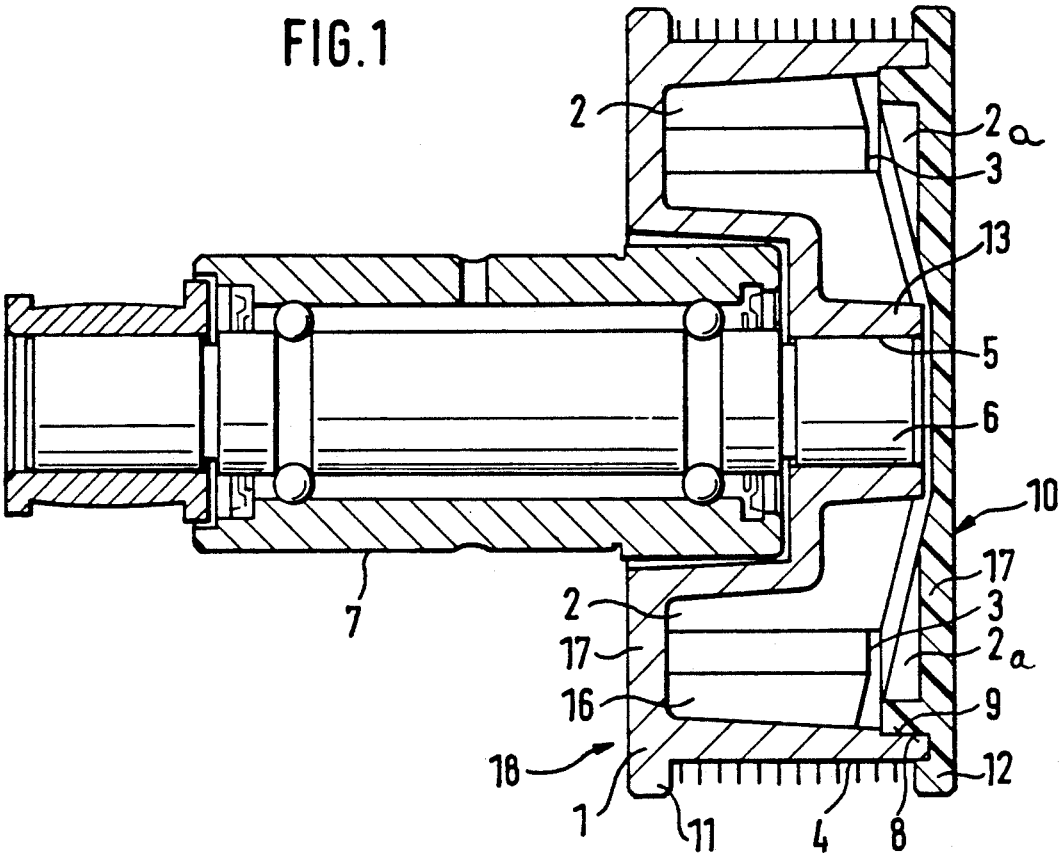
Figure 2:
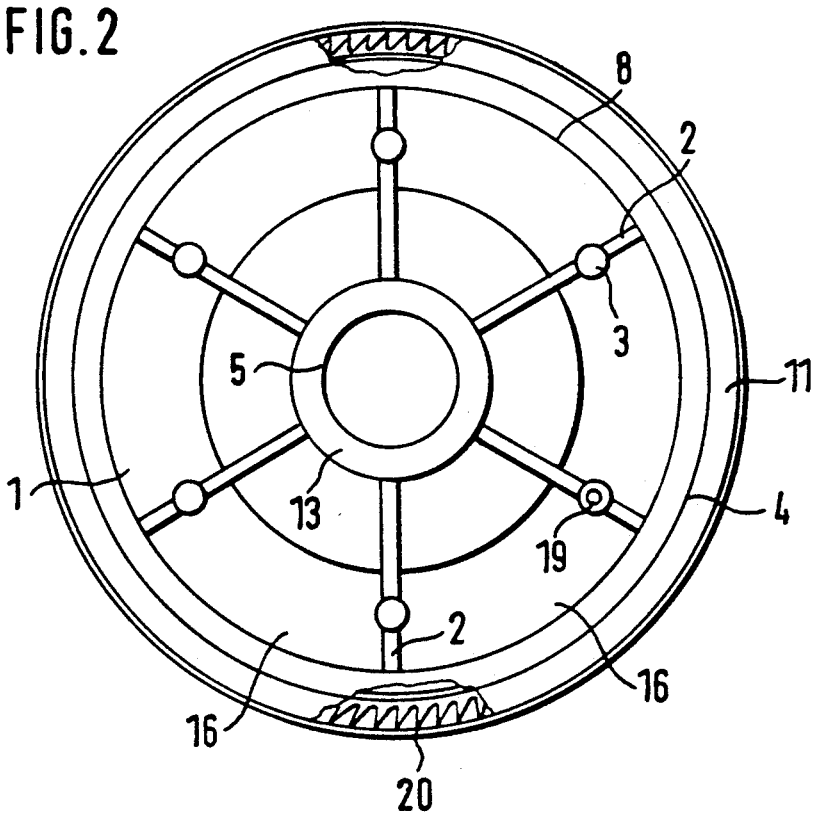
Figure 3:
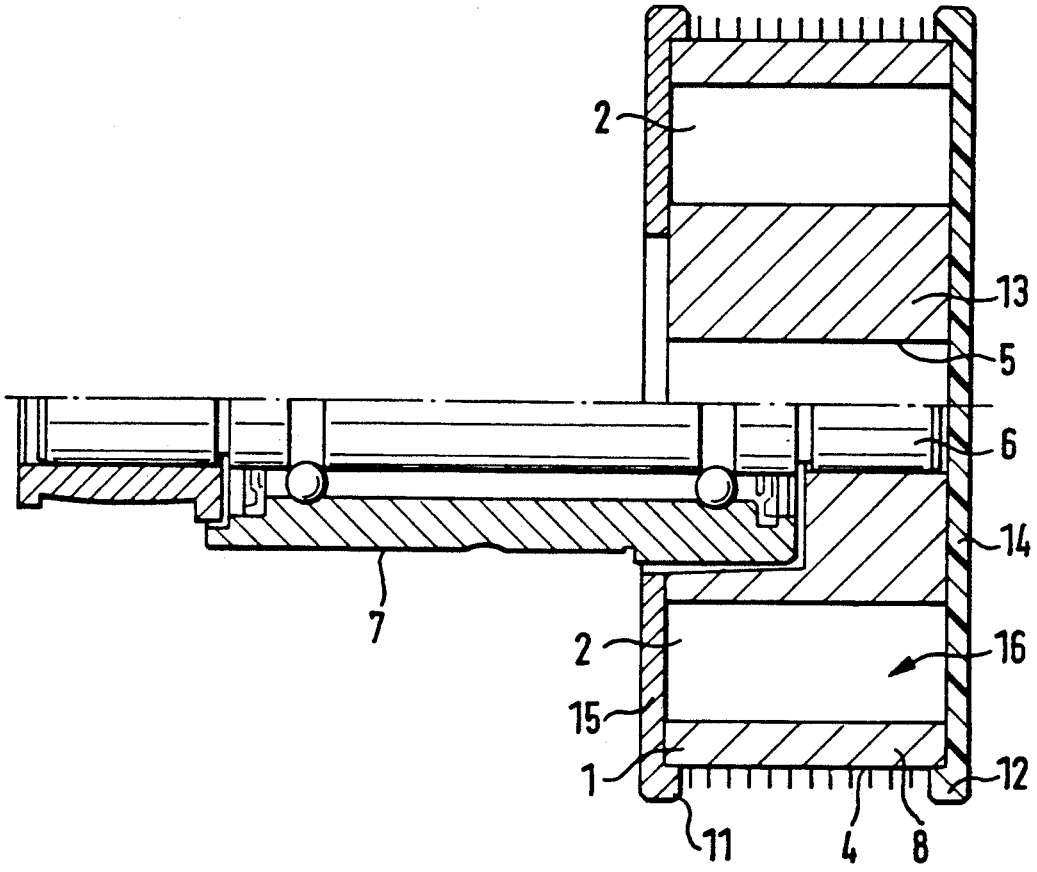

FIG. 1 shows a section through an opening roll; FIG. 2 shows a top view of the basic body of the opening roll' FIG. 3 shows a section through an opening roll.

FIG. 1 shows a section through an opening roll according to invention. A basic body consists of a bearing base body 1 as well as of a cover 10. The bearing base body 1 is delimited by a wall 17 which is connected by a hub 13 to a ring-shaped surface 4 which receives the clothing and which thus axially delimits a cavity 16 within the basic body. The bearing base body 1 is pressure-seated on a shaft 6. The shaft 6 is rotatably and bearingly supported in a bearing housing 7. The bearing housing 7 is partially enclosed by the bearing base body 1 at one end. The outer circumference of the bearing base body 1 serves to receive the clothing. This clothing-retaining surface 4 is delimited by a collar 11. The clothing-retaining surface 4 must meet the highest roundness requirements with respect to the shaft 6. The bearing base body 1 is preferably produced by aluminum die-casting. This makes it possible on the one hand to use thin walls and on the other hand makes it possible to produce even an unmachined part with low tolerances. By supporting the clothing-retaining surface 4 on the hub 13 by means of ribs 2 a high degree of roundness of even the unmachined part after die-casting is ensured.

The ribs 2 furthermore ensure that the shaft-retaining surface 5 can be made so as to also be round as well as rigid while having the thinnest possible walls.

The ribs 2 are provided with ejection surfaces 3. These ejection surfaces 3 ensure gentle ejection of the unmachined part from the die-casting tool. The ejection surfaces 3 are placed on the bearing base body 1 so that the pressure on the aluminum parts exerted by the ejector of the die-casting tool as it presses on the bearing base body 1 does not cause any deformation of said bearing base body 1. Such ejection surfaces are advantageously provided also on the cover 10.

A pressure surface 8 is provided at the open end of the clothing-retaining surface 4. The pressure surface 8 is the joining surface between the bearing base body 1 and the cover 10. The bearing base body 1 and the cover 10 together constitute the basic body of the opening roll. The cover 10 is provided with a pressure surface 9 corresponding to the pressure surface 8 of the bearing base body. The bearing base body 1 and the cover 10 are connected with each other via the pressure surfaces 8 and 9 and, when assembled, enclose a cavity in the opening roll. The cover 10 is advantageously protected against falling off during operation of the opening roll by means of an adhesive, in addition to the pressure.

The cover 10 is provided with ribs 2*a* in the cavity 16. The ribs 2 extend from the joining surface 9 radially towards the center of the cover 10. Thus an optimal relationship is obtained between strength and weight of the cover 10.

Known clothing rings (not shown) are clamped by means of cover 10 between the collar 11 and a collar 12 on the cover 10. It is however also possible to attach a clothing directly to the clothing-retaining surface 4. For this it may be advantageous to drill a screw-shaped groove into the clothing-retaining surface 4, in to which a saw-tooth wire is inserted. Furthermore, if the clothing is made of pins, these pins can be inserted directly into the clothing-retaining surface 4.

To achieve especially high precision in the roundness of the opening roll, the clothing-retaining surface 4, the shaft-retaining surface 5 as well as the pressure surfaces 8 and 9 are advantageously over-lathed. By this lightly-cutting finishing method the highest degree of dimensional precision is achieved.

The opening roll according to the invention is characterized in particular by the small amount of material used as well as by small finishing surfaces. Furthermore the worn clothing is replaced rapidly and cost-effectively.

If all the parts used are balanced separately it becomes advantageously possible to provide balancing bores inside the cavity, later to be closed, of the opening roll. This ensures especially low-noise running of the opening roll since the balancing bores produce no air eddies. Furthermore this ensures opening of the fiber sliver without malfunction, since no dirt or fiber particles can settle in the balancing bores. Balancing bores are preferably provided on the ejection surfaces 3 as there is much accumulation of material at that location, material which has no further function in the operation of the opening roll. A further advantageous design consists in adding material in the cavity to balance the opening roll. For this purpose lead, for example, can be attached to the ribs 2 or to the inside of the clothing-retaining surface 4.

FIG. 2 shows a top view of a bearing base body 1. In FIG. 2 the ribs 2 which are evenly distributed around the circumference are especially visible. It has been shown be advantageous to use a total of six ribs 2, since this results in an optimum ratio between roundness of the clothing-retaining surface 4 and the shaft receiving surface 5 and the amount of material required.

In addition to achieving great precision in manufacture, even in the unmachined part of the bearing base body 1, the ribs 2 prevent the clothing-retaining surface 4 from being pulled out of shape during the attachment of the clothing wire. The installation of the cover 10 on the bearing base body 1 can be realized, in addition to the shown manner, also by screwing it on, by locking it into place by means of a Belleville spring washer, by clamping by means of an 0-ring or by means of similar joining methods. It is important here to ensure that the cover 10 does not come loose from the bearing base body 1 during operation of the opening roll.

In the embodiment shown in FIG. 2, a balancing bore 19 is provided on one of the ribs 2 in the accumulation of material of the ejection surface 3.

In an advantageous embodiment the cover 10 is made of a synthetic material. This further reduces the weight of the opening roll and lowers the costs. Aluminum or zinc alloys are further advantageous materials to be used for the basic body. The highest degree of dimensional precision can be attained in manufacturing the unmachined part of a zinc alloy. In special cases the utilization of a wear-resistant synthetic material for the manufacture of the bearing base body 1 is also advantageous. The different materials used depend on the fiber material to be opened or on the type of clothing installed on the bearing base body 1.

In the instant embodiment a saw-tooth wire 20 is installed on the clothing-retaining surface 4.

The further embodiment according to the invention is shown in FIG. 3. Here the bearing base body 1 is produced by non-cutting shaping. The bearing base body 1 in this embodiment is a segment of a light-metal extruded profile which is finished by machining. The top of FIG. 3 shows the bearing base body 1 in its unfinished state. Here the recess for the bearing 7 is not yet provided. The shaft-retaining surface on the one hand and the recess on the other hand, to receive the bearing, as can be seen on the right side of FIG. 3, are made by machining. The hub 13 and the clothing-retaining surface 4 are connected by ribs, just as shown in FIGS. 1 and 2. The bearing base body 1 is closed by means of two covers 14 and 15. The bearing base body 1, the cover 14 and the cover 15 together constitute the basic body of the opening roll. The covers 14, 15 are attached to the bearing base body 1 via the collars and protect the cavity 16 from impurities and thus from imbalance during operation. The attachment of the covers 14, 15 can of course also be achieved by other connecting means ensuring operative functioning. They can be glued to the bearing base body 1 for example.

If the opening roll is especially well sealed against an opening roll housing, it is possible to dispense with the cover 14 and/or 15. In that case care must be taken to protect the cavity 16 as much as possible from impurities and thereby the opening roll from imbalance.

For special applications it may also be advantageous to utilize synthetic materials instead of light metals such as aluminum alloys. The bearing base body 1 consists in that case of segments of a extruded profile.

A rational production method is advantageous for the embodiment of FIG. 3. In particular a surface treatment or finishing of the clothing-retaining surface 4 can be effected already on the unmachined profile. Thus repeated setting up of the bearing base body 1 during machining is avoided.

The instant invention is not limited to the embodiments shown. It is thus possible, for instance, to provide an additional cylindrical separation wall between the shaft-retaining surface 5 and the clothing-retaining surface 4. In this manner advantages with respect to material distribution in casting or non-cutting shaping can be achieved, for example.

I claim:

1. An opening roll for an open-end spinning device upon which clothing is carried, a shaft upon which said opening roll is non-rotatably mounted, said opening roll comprising:

(a) a centrally located hub for receiving an end of said shaft, said hub having a longitudinal axis corresponding to a longitudinal axis of said shaft and outer and inner ends;

(b) a ring shaped concentric surface radially spaced from said hub for receiving said clothing;

(c) an end wall joining an inner end of said hub and said ring shaped concentric surface;

(d) said ring shaped concentric surface and said hub having substantially the same length;

(e) a plurality of circumferentially spaced ribs extending between said centrally located hub and said ring shaped concentric surface and also extending from said end wall to adjacent said outer end of said hub so that the length of said rubs are substantially the same as said length of said hub and said ring shaped concentric surface;

(f) an enlarged surface means interposed in some of said ribs for providing a surface upon which pressure can be applied for ejecting said hub, said ring shaped concentric surface, said end wall and said ribs from a mold without deformation and for permitting drilling and filling with material for balancing said opening roll;

(g) said enlarged surface means extending from adjacent and outer end of said hub to said end wall, and (h) said centrally located hub, said ring shaped concentric surface, said plurality of circumferentially spaced ribs, said enlarged surface means and said end wall being a one piece unitary member.

* * * * *